United States Patent [19]

McCormick

[11] 4,253,253

[45] Mar. 3, 1981

[54] ORNAMENTAL SHOE HEEL DEVICE

[76] Inventor: Arnold J. McCormick, 2455 Oakwood Manor Dr., Florissant, Mo. 63031

[21] Appl. No.: 43,458

[22] Filed: May 29, 1979

[51] Int. Cl.[3] ..... A43B 23/00

[52] U.S. Cl. ..... 36/137

[58] Field of Search ..... 36/137; 350/98

[56] References Cited

U.S. PATENT DOCUMENTS

| | | | |
|---|---|---|---|
| 2,976,622 | 3/1961 | Shearouse | 36/137 |
| 3,946,505 | 3/1976 | Dana | 36/137 |

FOREIGN PATENT DOCUMENTS

| | | | |
|---|---|---|---|
| 570614 | 9/1958 | Belgium | 36/137 |
| 444392 | 3/1936 | United Kingdom | 36/137 |

*Primary Examiner*—Patrick D. Lawson

[57] ABSTRACT

The present invention relates to an ornamental shoe heel device wherein a shoe is provided with a removable heel and the heel is provided with a battery, electrical wiring, and a light source providing illumination from the heel visible to those viewing the exterior of the heel.

3 Claims, 3 Drawing Figures

ORNAMENTAL SHOE HEEL DEVICE

BACKGROUND OF THE INVENTION

Conventional shoe design and manufacture generally involves providing ornamental features on the exterior surface of the shoe including the exterior surface of the heel. This is particularly true when the heel is a "high" heel as presently in use for the shoes of both men and women.

SUMMARY

It is therefore an object of the present invention to provide an ornamental shoe heel device which is provided with a power source, electrical wiring and a light source.

An object of the present invention is to provide such a device wherein the heel is removable from the shoe and also where the light produced by the light source is visible exterior of the shoe.

A further object of the present invention is to provide such a device which is simply and economically manufactured and used.

These together with other objects and advantages which will become subsequently apparent, reside in the details and construction and operation as more fully hereinafter described and claimed, reference being had to the accompanying drawings forming a part hereof, wherein like numerals refer to like parts throughout, and in which;

DETAILED DESCRIPTION OF THE INVENTION

Figure 1:
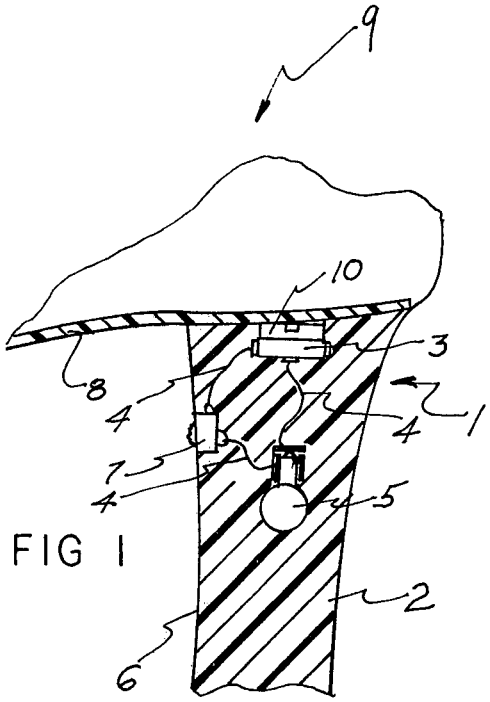
FIG. 1 is a sectional elevation view of an ornamental shoe heel device constructed in accordance with and embodying the present invention.

Referring now in more detail and by reference characters to the drawings which illustrate practical embodiments of the present invention, FIG. 1, is a sectional elevation view of an ornamental shoe heel 1, constructed in accordance with, used in and embodying the present invention.

Figure 2:
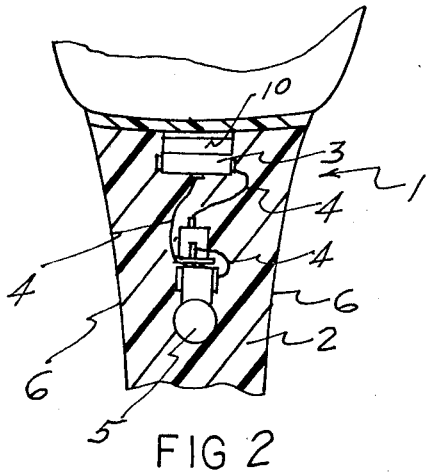
FIG. 2 is an elevation view of the device in FIG. 1.

As shown in FIG. 1 and FIG. 2, ornamental shoe heel device 1, comprises heel body 2, battery 3, electrical conductors 4, and light 5.

In the preferred embodiment, heel body 2, will be transparent and tinted with various colors. Further, the exterior surface 6, of heel body 2, preferably is provided with ornamental indicia, not shown. Light 5, may burn steadily or switch 7, may be added to allow turning the light on and off when desired. Automatic light sequencing means may be provided instead of or in addition to switch 7, to alternately turn light 5, on and off.

In order to replace battery 3, insole 8, of shoe 9, is raised, battery cover 10, is then removed and battery 3, may then be replaced.

Figure 3:
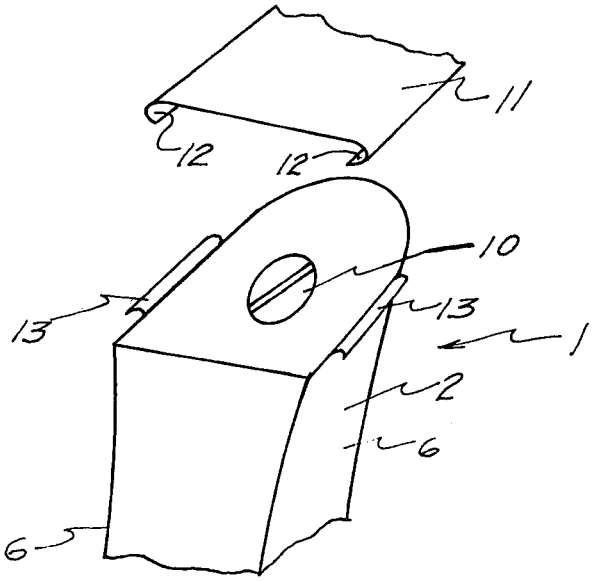
FIG. 3 is a perspective view of another embodiment to that shown in FIG. 1 constructed in accordance with and embodying the present invention.

FIG. 3 illustrates another facet of the present invention wherein plate 11, is attached to the undersurface of the shoe 9, proper and plate 11, is provided with tracks 12, into which projections 13, on heel body 2, are disposed, thereby securing heel body 2, to shoe body 9.

It should be understood that changes and modifications in the form, construction, arrangement, and combination of the Ornamental Shoe Heel Device and methods of making and using the same may be made and substituted for those herein shown and described without departing from the nature and principle of my invention.

Having thus described my invention, what I claim is new and desire to secure by United States Letters Patent is:

1. An ornamental shoe heel for use with a conventional shoe body which is provided with a heel said heel provided with a battery chamber disposed proximate the top of said heel comprising, light means operably mounted in said heel, said heel being constructed of partially transparent material, electrical conductors operably coupled to said light means, battery means operably coupled to said electrical conductors, said battery means mounted in said battery chamber, chamber closure means removably mounted in said battery chamber and providing an interface between said battery chamber and the top of said heel.

2. An ornamental shoe heel as described in claim 1 provided with attachment means for removably mounting said heel to said shoe.

3. An ornamental shoe heel as described in claim 2 wherein said attachment means comprises a pair of elongated projections operably mounted on the top of said heel in combination with a pair of tracks operably mounted on the under surface of the shoe body.

* * * * *